US006868903B2

(12) United States Patent
Mitchell et al.

(10) Patent No.: US 6,868,903 B2
(45) Date of Patent: Mar. 22, 2005

(54) PRODUCTION TOOL

(76) Inventors: Bruce Stephen Mitchell, 2731 Loughead Drive S.W., Calgary, Alberta (CA), T3E 5T7; Donald James Almond, 159 Valley Ridge Green, N.W., Calgary, Alberta (CA), T3B 5L6

( * ) Notice: Subject to any disclaimer, the term of this patent is extended or adjusted under 35 U.S.C. 154(b) by 81 days.

(21) Appl. No.: 10/294,635

(22) Filed: Nov. 15, 2002

(65) Prior Publication Data

US 2003/0155113 A1 Aug. 21, 2003

(30) Foreign Application Priority Data

Nov. 16, 2001 (CA) ..... 2363183

(51) Int. Cl.[7] ..... E21B 43/00; F01D 3/02
(52) U.S. Cl. ..... 166/105; 416/199; 415/102
(58) Field of Search ..... 166/105, 105.1, 166/105.2, 177.7; 416/176, 177, 199; 415/72, 73, 102

(56) References Cited

U.S. PATENT DOCUMENTS

| | | | | | |
|---|---|---|---|---|---|
| 762,808 | A | * | 6/1904 | Cushing et al. | 417/89 |
| 1,600,440 | A | * | 9/1926 | White | 415/72 |
| 2,184,496 | A | * | 12/1939 | Hale | 415/72 |
| 3,077,932 | A | * | 2/1963 | Gehrke | 166/68 |
| 5,209,293 | A | * | 5/1993 | McNaughton et al. | 166/68.5 |

* cited by examiner

*Primary Examiner*—Ken Thompson

(57) ABSTRACT

A production tool for use in heavy oil production is provided. Operating to provide for better inflow of oil and sand to a bottom hole rotating pump, the production tool prevents sand up conditions and keeps the well cellar and the walls of the casing clean to ensure longer periods between workovers. The production tool has a cylindrical member with at least one helical fin extending substantially to the inner radius of the casing, and a gear reducer which drives the cylindrical member at a reduced rotation from input from the rotor of the bottom hole rotating pump. The rotational motion of the cylindrical member in conjunction with the sense of the helical fin cause bore effluence to move to the intake of the rotating pump, effecting constant inflow.

14 Claims, 3 Drawing Sheets

PRODUCTION TOOL

FIELD OF THE INVENTION

This invention relates to heavy oil well drilling, and more particularly to sand bearing oil production in heavy oil areas.

BACKGROUND OF THE INVENTION

In heavy oil well production, a rotating pump within the well bore causes the movement of sand and oil to the surface. Tubing of a smaller diameter than the well bore is used to convey bore effluence to the surface. The rotating pump will typically have a rotor which comprises a screw like member made of rubber or polyurethane of roughly the same diameter as the tubing, which due to its rotation pushes bore effluence up the tubing. The rotor generally has two portions, the main portion of which is situated in for example a neoprene bladder or mould which is attached to the tubing, the other portion of which extends below the main portion and has a region for intake of materials to the rotating pump. The rotating pump relies on the natural flow of bore effluence in the cellar for the required inflow of effluence to its intake. Rotating pumps will typically work well as long as inflow is always present but if inflow is slowed down or stops because of sand problems or water knocking sand out, the pump can be inhibited or even stop working altogether. Sand build-up conditions are more likely it sand and well bore effluence are not kept mobile in the well bore, or if a constant intake is not provided to the bottom hole rotating pump. In addition to causing inflow and pump problems, sand up and poor effluence flow problems can cause deposits on the well cellar and walls of the casing, in which case production must be stopped for well maintenance workover operations. Relying on the natural flow of bore effluence to provide inflow to the rotating pump in the well bore does not address these problems which can occur naturally and are very undesirable.

It would be desirable in heavy oil well production for a tool to provide for better inflow of oil and sand to the pump, and provide for a way to keep the well cellar and the walls of the casing clean to ensure longer periods between workovers.

SUMMARY OF THE INVENTION

The present invention provides a production tool to break down sand build up in heavy oil wells and convey the sand and oil to the pump and mitigates some of the problems associated with known techniques in heavy oil well production.

According to a first broad aspect, the invention provides for a production tool to provide intake to a bottom hole rotating pump having a rotor, the production tool having at least one cylindrical member, the cylindrical member having at least one helical fin wound about its outer surface, the production tool having a gear reducer, in which the gear reducer is connected to the cylindrical member and is adapted to be connected to the rotor of the rotating pump, and in which the gear reducer is adapted to output a reduced rotation to the cylindrical member from a rotational input from the rotating pump.

In some embodiments of the invention, the cylindrical member has an axial bore defining an inner surface of a cylindrical member wall, the axial bore being adapted to accommodate passage of the rotor of the rotating pump therein for access to the gear reducer, and wherein the cylindrical member wall has a pump intake adapted to allow passage of material from the outside of the cylindrical member into the axial bore and to an intake of the rotating pump, said intake located within the axial bore.

In some embodiments of the invention, the production tool is adapted to operate within a cylindrical casing, and a radius of the helical fin extends to a radius less than a radius of an inner surface of a wall of the casing. In some embodiments of the invention the radius of the helical fin extends substantially to a radius of an inner surface of a wall of the casing.

In some embodiments of the invention, the gear reducer is adapted to output a rotation of between 10 to 30 RPM to the cylindrical member from a rotational input from the rotating pump of between 75 to 200 RPM.

According to a second broad aspect, the invention provides for a production tool to provide intake to a bottom hole rotating pump having a rotor, the production tool having an upper cylinder, the upper cylinder having at least one helical fin wound about its outer surface in a first winding direction, the production tool having a lower cylinder, the lower cylinder having at least one helical fin wound about its outer surface in a second winding direction in a sense opposite to the first winding direction, the production tool having a gear reducer, in which the gear reducer is connected to the upper cylinder and the lower cylinder and is adapted to be connected to the rotor of the rotating pump, and in which the gear reducer is adapted to output a reduced rotation to the upper cylinder and the lower cylinder from a rotational input from the rotating pump, and in which the upper cylinder has an axial bore defining an inner surface of an upper cylinder wall, the axial bore being adapted to accommodate passage of the rotor of the rotating pump therein for access to the gear reducer, and in which the upper cylinder wall has a pump intake adapted to allow passage of material from the outside of the upper cylinder into the axial bore and to an intake of the rotating pump, said intake located within the axial bore, In some embodiments of the invention, the gear reducer is adapted to output a rotation of between 10 to 30 RPM to the upper cylinder and the lower cylinder from a rotational input from the rotating pump of between 75 to 200 RPM.

In some embodiments of the invention, the production tool is adapted to operate within a casing, and radii of the at least one helical fin of the upper cylinder and the at least one helical fin of the lower cylinder extend to radii less than a radius of an inner surface of a wall of the casing. In some embodiments of the invention, radii of the at least one helical fin of the upper cylinder and the at least one helical fin of the lower cylinder extend substantially to a radius of an inner surface of a wall of the casing.

According to a third broad aspect the invention provides for an arrangement of downhole production equipment including a bottom hole rotating pump having a rotor, and a production tool comprising a gear reducer and at least one cylindrical member having at least one helical fin wound about its outer surface, in which the gear reducer has an output connected to the cylindrical member, has an input connected to the rotor of the rotating pump, and is adapted to output a reduced rotation to the cylindrical member from a rotational input from the rotating pump.

In some embodiments of the invention, the arrangement of downhole production equipment is adapted to operate within a cylindrical casing, in which a radius of the helical fin extends to a radius less than a radius of an inner surface of a wall of the casing. In some embodiments of the invention, the arrangement of downhole production equipment is adapted to operate within a cylindrical casing, in which a radius of the helical fin extends substantially to a radius of an inner surface of a wall of the casing.

Other aspects and features of the present invention will become apparent to those of ordinary skill in the art upon review of the following description of specific embodiments of the invention in conjunction with the accompanying figures.

BRIEF DESCRIPTION OF THE DRAWINGS

The invention will now be described in greater detail with reference to the accompanying diagrams, in which.

DETAILED DESCRIPTION OF THE PREFERRED EMBODIMENTS

The preferred embodiment ensures inflow of oil and sand to the pump while keeping the well cellar and the walls of the casing clean thereby ensuring smooth production and longer periods between workovers. By providing a constant feed for the pump intake and ensuring sand build-up around the pump intake is not occurring, effluent will continue to move into and through the pump and will not cause the pump to sand up.

Figure 1:
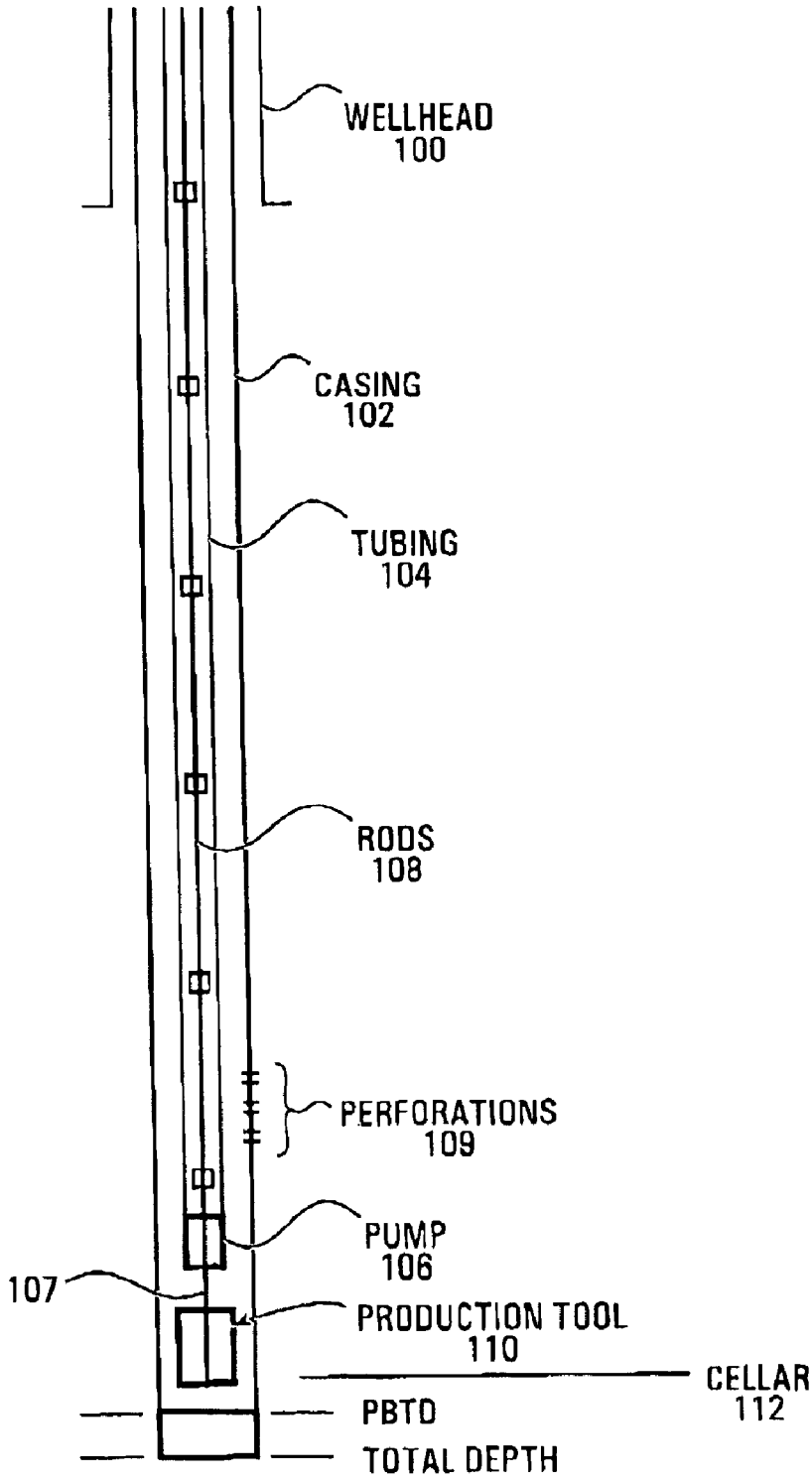
FIG. 1 is a cross-sectional schematic diagram of downhole equipment in a heavy oil well, the downhole equipment including a production tool constructed according to an embodiment of the invention.

Referring to FIG. 1, a production tool 110 provided by an embodiment of the invention is shown together with typical downhole equipment for heavy oil well production. The tool can be used with other downhole equipment as well. A hollow tube-like metal cylinder called a casing 102 extends from a wellhead 100 to a cellar 112, defining a depth called the PBTD (Plug Back Total Depth). The cellar 112 is defined as the region of the well which extends from the bottom of perforations 109 to the PBTD of the drilled well. Concentric with the casing 102 is metal tubing 104 which extends down into the well to a rotating pump 106. Along the axis of the casing are rods 108 which extend from the well head 100 to the pump 106. Typically the rods 108 drive the rotating pump 106; however the tubing 104 itself may be used for this purpose. The oil and sand material to be extracted from the well are pumped up the tubing 104 by the operation of the pump 106. Typically a rotating pump 106 comprises a screw like member made of rubber or polyurethane of roughly the same diameter as the tubing 104 and is driven typically at 75 to 200 rotations per minute (RPM). The production tool 110 constructed according to an embodiment of the invention is attached to the pump 106.

Figure 2:
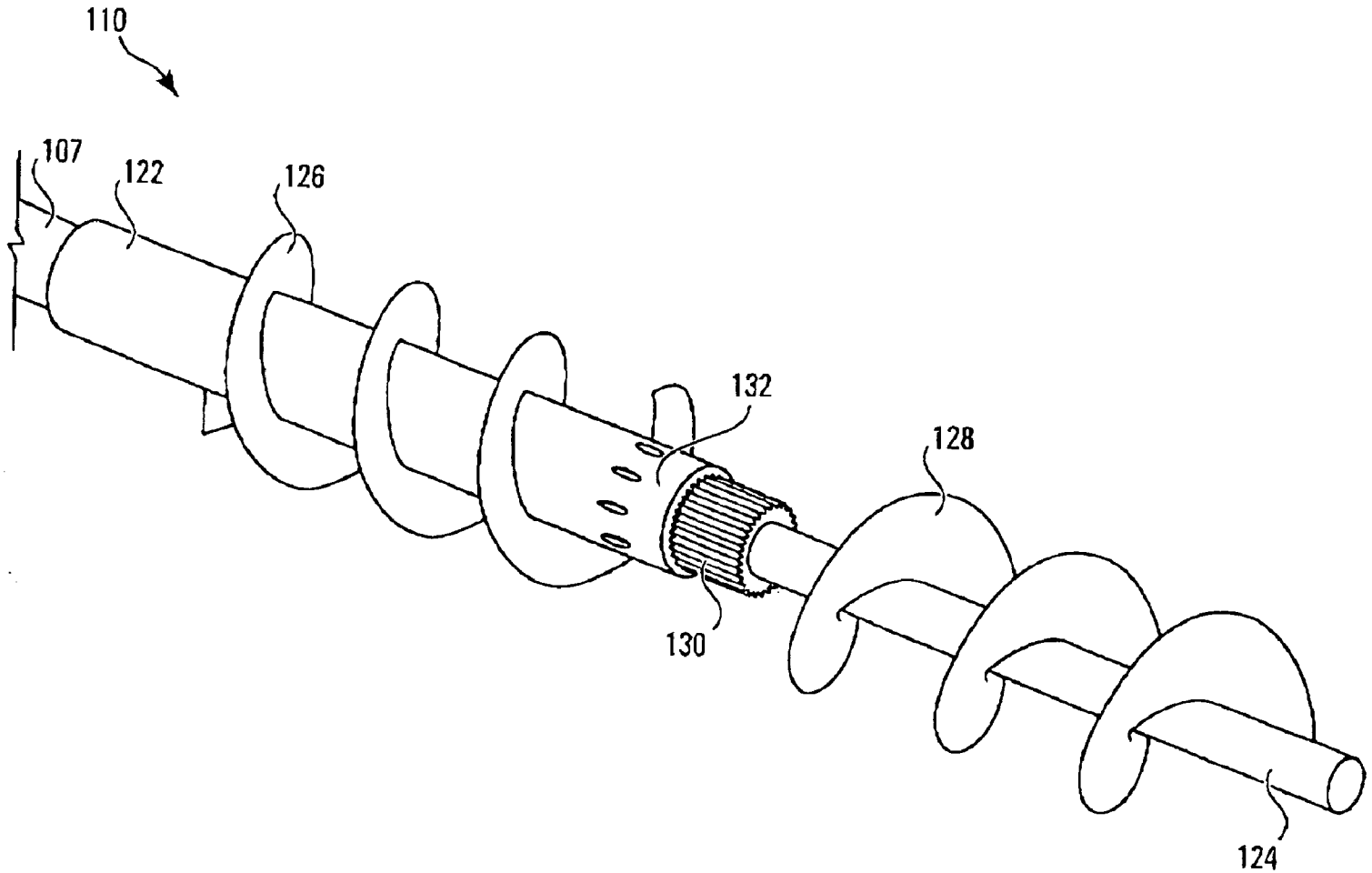
FIG. 2 is an isometric view of an embodiment of the production tool.

Referring now to FIG. 2, a preferred embodiment of the production tool will be described. The production tool 110 consists of a hollow upper cylinder 122 and a lower cylinder 124. A rotor 107 of the rotating pump 106 passes through a bore in the upper cylinder 122 and is connected to a gear reducer 130 located about midway along the height of the production tool 110. In the preferred embodiment the rotor 107 of the rotating pump 106 has an auger on its outer surface along most of its length defining a region herein referred to as the intake of the rotating pump 106. This intake of the rotating pump 106 moves material toward the main portion of the pump which as described above is typically housed in a neoprene mould. It should be noted that although a specific example rotating pump has been described in association with the preferred embodiment of the production tool, other rotating pumps with other types of intakes may be used in co-operation with the production tool. The main body of the rotating pump 106 in the preferred embodiment sits above the production tool 110. The gear reducer 130 has an output gear connected to both the upper cylinder 122 and the lower cylinder 124. A standard gear reducer has an input end and an output end, the input end for being connected to an input rotation of high rotational speed and an output end for providing a reduced rotational speed. The upper cylinder 122 has an upper helical fin 126 wound about its outer surface. The lower cylinder 124 has a lower helical fin 128 wound about its outer surface. Both the upper helical fin 126, and the lower helical fin 128 extend radially to a radius equal to or less than an inner radius of the casing 102. In an exemplary embodiment of the production tool 110, the upper and lower helical fins extend to a radius substantially equal to the inner radius of the casing 102 to within operating mechanical tolerances. In the preferred embodiment of the production tool 110, the upper helical fin 126 is wound about the upper cylinder 122 in a sense opposite to the sense of the winding of the lower helical fin 128 about the lower cylinder 124. In general the upper cylinder 122 and the lower cylinder 124 may have differing diameters, due in part from the absence of a need for a bore in the lower cylinder.

Figure 3:
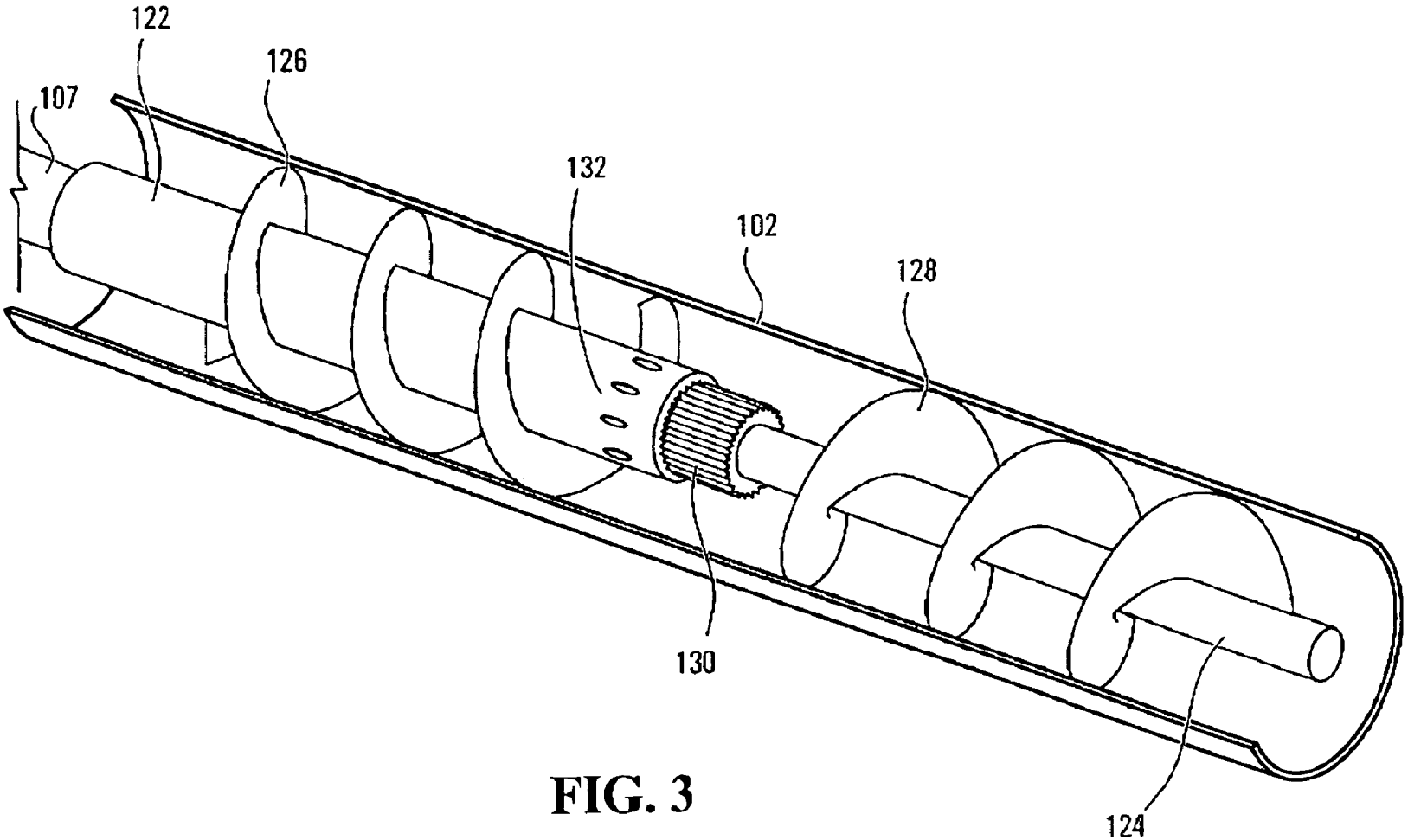
FIG. 3 is an isometric view of the production tool of FIG. 2 in operation inside the casing.

Referring now to FIG. 3, the operation of the production tool 110 inside the casing 102 will be described. The cylinders 122 and 124 of the production tool 110 are driven using the rotation supplied by the rotor 107 of the rotating pump 106 to the gear reducer 130. Typically, the rotor 107 of the rotating pump 106 rotates at a speed of between approximately 75 to 200 RPM, and the gear reducer 130 acts to reduce this rotational speed which is imparted to the upper cylinder 122 and the lower cylinder 124. In the preferred embodiment the rotational speed is reduced to between approximately 10 to 30 RPM, and in an exemplary embodiment to 20 RPM. Other speeds can be used as required by a given implementation. This reduction in rotational speed is made to ensure that the cylinders of the production tool 110 rotate at a speed within mechanical tolerances, and to reduce wear and tear on the production tool.

The rotation of the production tool 110 will generally be chosen to be in a sense which, in conjunction with the sense of the upper helical fin 126 and the lower helical fin 128, causes the movement of bore effluence toward the area between the upper cylinder 122 and the lower cylinder 124. Specifically, the bore effluence in the region surrounding the upper cylinder 122 will move in a downward direction in response to the rotation of the upper helical fin 126, while the bore effluence in the region surrounding the lower cylinder 124 will move in an upward direction in response to the rotation of the lower helical fin 128. In the area of the gear reducer 130, in the lower portion of the upper cylinder 122, is a pump intake 132 which comprises openings or slots in the upper cylinder 122. The pump intake 132 allows the passage of desired material exterior to the production tool 110 into the bore of the upper cylinder 122 from which it passes to the intake of the rotating pump 106. Although not shown in the figures, the rotation imparted to the rotor of the rotating pump, may originate from the rotational motion of the tubing 104 instead of from the rods 108.

In the most general arrangement the production tool 110 may comprise only one of the upper or the lower cylinder.

In the case that only the upper cylinder 122 is present, its rotational motion and the sense of the windings of the upper helical fin 126 are such that bore effluence moves in a downward direction to the pump intake 132. In the case that only the lower cylinder 124 is present, its rotational motion and the sense of the windings of the lower helical fin 128 are such that bore effluence moves in an upward direction to the pump intake 132. In this arrangement, the upper cylinder may be replaced with a similar hollow cylinder which would be similarly attached to the gear reducer 130, similarly comprise a pump intake 132, and similarly provide passage of bore effluence to the rotating pump 106, however, this cylinder would not comprise a helical fin, and typically could be shorter than the upper cylinder 122 of the preferred embodiment. This arrangement may alternatively not require the presence of any sort of upper cylinder. Due to the operation of the production tool 110, specifically its ability to move bore effluence in an upward, downward or in a downward and upward direction, constant intake to the bottom hole rotating pump is provided, helping to prevent sand problems or water knocking sand out, to ensure operation of the pump. Through the use of fins extending substantially toward the inner radius of the casing 102 and directing bore effluence towards the pump intake, sand up conditions and poor effluence flow are avoided, and deposits on the well cellar and the walls of the casing are prevented for smooth production.

What has been described is merely illustrative of the application of the principles of the invention. Other arrangements and methods can be implemented by those skilled in the art without departing from the spirit and scope of the present invention. For example, instead of the production tool of the preferred embodiment comprising two cylinders attached to the gear reducer, the production tool may comprise a single cylindrical member with an upper portion and a lower portion configured and functioning like the upper and lower cylinders respectively as described above.

We claim:

1. A production tool for providing intake to a bottom hole rotating pump having a rotor, the production tool comprising:

at least one cylindrical member having at least one helical fin wound in a particular winding direction about its outer surface; and a gear reducer;

wherein the gear reducer is connected to the cylindrical member and is adapted to be connected to the rotor of the rotating pump, and wherein the gear reducer is adapted to output a reduced rotation to the cylindrical member from a rotational input from the bottom hole rotating pump; and wherein the direction of rotation of the cylindrical member and the winding direction of the helical fin are selected to cause the helical fin to move material towards an intake of the bottom hole rotating pump.

2. A production tool according to claim 1 wherein the cylindrical member has an axial bore defining an inner surface of a cylindrical member wall, the axial bore being adapted to accommodate passage of the rotor of the rotating pump therein for access to the gear reducer, and wherein the cylindrical member wall has a pump intake adapted to allow passage of material from the outside of the cylindrical member into the axial bore and to the intake of the rotating pump, said intake located within the axial bore.

3. A production tool according to claim 2 wherein the production tool is adapted to operate within a cylindrical casing, and wherein a radius of the helical fin extends to a radius less than a radius of an inner surface of a wall of the casing.

4. A production tool according to claim 2 wherein the production tool is adapted to operate within a cylindrical casing, and wherein a radius of the helical fin extends substantially to a radius of an inner surface of a wall of the casing.

5. A production tool according to claim 2 wherein the gear reducer is adapted to output a rotation of between 10 to 30 RPM to the cylindrical member from a rotational input from the rotating pump of between 75 to 200 RPM.

6. A production tool to provide intake to a bottom hole rotating pump having a rotor, the production tool comprising:

an upper cylinder having at least one helical fin wound about its outer surface in a first winding direction;

a lower cylinder having at least one helical fin wound about its outer surface in a second winding direction in a sense opposite to the first winding direction; and a gear reducer;

wherein the gear reducer is connected to the upper cylinder and the lower cylinder and is adapted to be connected to the rotor of the rotating pump, and wherein the gear reducer is adapted to output a reduced rotation to the upper cylinder and the lower cylinder from a rotational input from the rotating pump, and wherein the upper cylinder has an axial bore defining an inner surface of an upper cylinder wall, the axial bore being adapted to accommodate passage of the rotor of the rotating pump therein far access to the gear reducer, and wherein the upper cylinder wall has a pump intake adapted to allow passage of material from the outside of the upper cylinder into the axial bore and to an intake of the rotating pump, said intake located within the axial bore; and wherein the direction of rotation of the upper and lower cylinders and the first and second winding direction are selected to cause the respective helical fins to move material towards the pump intake.

7. A production tool according to claim 6 wherein the production tool is adapted to operate within a casing, and wherein radii of the at least one helical fin of the upper cylinder and the at least one helical fin of the lower cylinder extend to radii less than a radius of an inner surface of a wall of the casing.

8. A production tool according to claim 6 wherein the production tool is adapted to operate within a casing, and wherein radii of the at least one helical fin of the upper cylinder and the at least one helical fin of the lower cylinder extend substantially to a radius of an inner surface of a wall of the casing.

9. A production tool according to claim 6 wherein the gear reducer is adapted to output a rotation of between 10 to 30 RPM to the upper cylinder and the lower cylinder from a rotational input from the rotating pump of between 75 to 200 RPM.

10. An arrangement of downhole production equipment comprising:

a bottom hole rotating pump having an intake and a rotor; and a production tool comprising a gear reducer and at least one cylindrical member having at least one helical fin wound in a particular direction about its outer surface;

wherein the gear reducer has an output connected to the cylindrical member, has an input connected to the rotor of the rotating pump, and is adapted to output a reduced rotation to the cylindrical member from a rotational input from the bottom hole rotating pump; and wherein the direction of rotation of the cylindrical member and the winding direction of the helical fin are selected to cause the helical fin to move material towards the intake of the bottom hole rotating pump.

11. An arrangement of downhole production equipment according to claim 10 wherein the cylindrical member has an axial bore defining an inner surface of a cylindrical member wall, the axial bore being adapted to accommodate passage of the rotor of the rotating pump therein for access to the gear reducer, and wherein the cylindrical member wall has a pump intake adapted to allow passage of material from the outside of the cylindrical member into the axial bore and to the intake of the rotating pump, said intake located within the axial bore.

12. An arrangement of downhole production equipment according to claim 11 wherein the arrangement of downhole production equipment is adapted to operate within a cylindrical casing, and wherein a radius of the helical fin extends to a radius less than a radius of an inner surface of a wall of the casing.

13. An arrangement of downhole production equipment according to claim 11 wherein the arrangement of downhole production equipment is adapted to operate within a cylindrical casing, and wherein a radius of the helical fin extends substantially to a radius of an inner surface of a wall of the casing.

14. An arrangement of downhole production equipment according to claim 11 wherein the gear reducer is adapted to output a rotation of between 10 to 30 RPM to the cylindrical member from a rotational input from the rotating pump of between 75 to 200 RPM.

* * * * *